US007740923B2

(12) United States Patent
Exner et al.

(10) Patent No.: US 7,740,923 B2
(45) Date of Patent: Jun. 22, 2010

(54) METHOD AND APPARATUS FOR PRODUCING A PACKAGE OR FOR PACKAGING A FOOD PRODUCT

(75) Inventors: Ronald H. Exner, Icking (DE); Olav Dagestad, Oslo (NO)

(73) Assignee: Kraft Foods R & D, Inc., Northfield, IL (US)

( * ) Notice: Subject to any disclaimer, the term of this patent is extended or adjusted under 35 U.S.C. 154(b) by 1100 days.

(21) Appl. No.: 11/279,497

(22) Filed: Apr. 12, 2006

(65) Prior Publication Data

US 2006/0257599 A1 Nov. 16, 2006

(30) Foreign Application Priority Data

Apr. 18, 2005 (EP) ..... 05008398

(51) Int. Cl.
*B29D 22/00* (2006.01)
*B29D 23/00* (2006.01)
*B32B 1/08* (2006.01)

(52) U.S. Cl. ..... 428/35.2; 428/34.1; 428/347; 428/915; 428/916; 206/807; 220/DIG. 34

(58) Field of Classification Search ..... 428/35.2, 428/34.1, 347, 915, 916; 206/807; 220/DIG. 34
See application file for complete search history.

(56) References Cited

U.S. PATENT DOCUMENTS

| | | | |
|---|---|---|---|
| 3,410,393 | A | 11/1968 | Lee |
| 3,536,501 | A | 10/1970 | Work |
| 3,938,659 | A | 2/1976 | Wardwell |
| 4,718,553 | A | 1/1988 | Adamoli et al. |
| 4,972,953 | A | 11/1990 | Friedman et al. |
| 4,980,222 | A | 12/1990 | Rivera et al. |
| 5,064,664 | A | 11/1991 | Hustad |
| 5,103,979 | A | 4/1992 | Hustad |
| 5,149,386 | A | 9/1992 | Smits et al. |
| 5,582,887 | A | 12/1996 | Etheredge |
| 5,798,169 | A | 8/1998 | Smith |
| 5,918,983 | A | 7/1999 | Palazzolo |
| 5,924,795 | A | 7/1999 | Thompson et al. |
| 6,033,762 | A | 3/2000 | Decker |
| 6,096,387 | A | 8/2000 | Decker |
| 6,149,302 | A | 11/2000 | Taheri |

(Continued)

FOREIGN PATENT DOCUMENTS

| | | |
|---|---|---|
| DE | 19828178 | 9/1999 |

(Continued)

OTHER PUBLICATIONS

EP Search Report 05008398, Jul. 25, 2005, EPO.

*Primary Examiner*—Michael C Miggins
(74) *Attorney, Agent, or Firm*—Fitch, Even, Tabin & Flannery

(57) ABSTRACT

A package material with a tamper evident feature and methods of manufacture thereof, are disclosed herein. The package comprises a colored primer or lacquer coating applied along a portion of a seal and further comprising a peelable sealant. When opened the peelable sealant is separated from the portion of the seal containing colored primer or lacquer and removes a section of the coating, thus providing a visual indication that the package has been opened.

27 Claims, 5 Drawing Sheets

U.S. PATENT DOCUMENTS

| | | | |
|---|---|---|---|
| 6,428,867 | B1 | 8/2002 | Scott et al. |
| 6,471,058 | B2 | 10/2002 | Kannabiran et al. |
| 2001/0022280 | A1 | 9/2001 | Kannabiran et al. |

FOREIGN PATENT DOCUMENTS

| | | | |
|---|---|---|---|
| EP | 0303400 | A2 | 2/1989 |
| EP | 0341699 | A1 | 11/1989 |
| EP | 0404402 | A2 | 12/1990 |
| EP | 0450960 | A2 | 10/1991 |
| EP | 0493465 | A1 | 7/1992 |
| EP | 0773889 | A2 | 5/1997 |
| EP | 0805018 | A2 | 11/1997 |
| EP | 1113058 | A2 | 7/2001 |
| EP | 1288139 | | 3/2003 |
| JP | 6286768 | A | 10/1994 |
| JP | 6286769 | A | 10/1994 |
| JP | 7271302 | A | 10/1995 |
| JP | 2003041215 | A | 2/2003 |
| JP | 2003221060 | A | 8/2003 |
| JP | 2003316271 | A | 11/2003 |
| JP | 2003341694 | A | 12/2003 |
| WO | 9604177 | | 2/1996 |
| WO | 0046122 | | 8/2000 |
| WO | 0104014 | A1 | 1/2001 |

METHOD AND APPARATUS FOR PRODUCING A PACKAGE OR FOR PACKAGING A FOOD PRODUCT

FIELD

The invention relates to a package, a food product packaged with the package, as well as a method and a machine for producing a packaging material or for packaging a food product and a packaging material produced thereby.

Particularly in the field of packages for food products, it is desirable to provide the consumer with a package, which is both easy to open and re-closable. However, with re-closable packages it is an issue that the package might have been opened and re-closed before the consumer purchases and/or consumes the food product contained in the package. In other words, it is important for the consumer to know whether a third person (or the consumer himself, beforehand) has tampered with or opened the package. This information is important as it will influence the consumer's decision to purchase the product and/or the consumer's decision to consume the product despite the fact that the package has been opened and re-closed and the food product contained therein might not be in the original state and might, particularly, not be in a fresh state.

BACKGROUND

As far as tamper evidence is concerned, it is known to provide additional mechanical features, such as a sticker or a label, which need to be broken in order to open the package. This type of tamper evidence complicates the manufacturing and the packaging process and, moreover, deteriorates the easy to open properties of the package.

EP 0 341 699 B1 discloses tamper indicating containers and seals, in which a colorant is at least partially removed, when the seal is first opened, so that the first opening is indicated, and the consumer can realise that the package has been tampered with. A similar tamper evidence seal and tape is disclosed in WO 96/04177.

EP 1 288 139 of the Applicant discloses a package for packing food products which is easy to open due to the presence of two easily gripable flaps having a different width.

SUMMARY

It is an object underlying the invention to provide a package which is improved with regard to its tamper evidence features, as well as a food product packaged therewith. Furthermore, the invention provides a method and a machine for producing a packaging material or for packaging a food product which can produce a package, which comprises improved tamper evidence. Finally, a packaging material produced thereby is also subject matter of the invention.

The package according to the invention is described in claim 1. Preferred embodiments thereof are the subject of the further claims.

The package according to the invention comprises, firstly, a substrate. The substrate can be any type of film or foil from any type of suitable material, such as polyethylene or polypropylene or paper coated with a plastic material. In particular, the substrate can advantageously be suitable for the production of so-called flow packs, i.e. packages which are produced by wrapping a foil or film material around a succession of products, sealing the foil or film to itself between products and producing a so-called fin seal parallel to the machine direction, i.e. the direction of the succession of products. The packed products are separated from one another by cutting transversely to the machine direction in the area of the seals, which are formed between the products.

In the inventive package, a first and a second surface portion of the substrate are sealed to each other. The first and second surface portion can, for example, be parallel to each other and can, moreover, be parallel to the machine direction and thus constitute the above-described fin seal. These surface portions can be sealed to each other by a cold or heat seal as desired. The seal can be patterned, i.e. the sealant or adhesive producing the seal can be applied in a pattern, such as plural dots, stripes or any other suitable pattern and the first and second surface portions can, moreover, be subjected to embossing in order to improve the strength of the seal.

A third surface portion adjacent the first surface portion is at least partially covered by a coating. It can be mentioned that the third surface portion can act as a type of flap or tab adjacent the first surface portion that can be gripped when it is desired to open the package, in order to achieve an easy opening of the seal constituted by the first and second surface portions. It can, moreover, already be mentioned that the coating of the third surface portion has a particular colour in order to provide a tamper evidence feature. In particular, a binding force, between the coating and the substrate, has a first value. This first value will be in a specific relationship with the values of further binding forces, as detailed below, in order to provide the tamper evidence feature.

A fourth surface portion is present adjacent the second surface portion and is only partially covered with an adhesive. In a manner corresponding to the third surface portion, the fourth surface portion can be considered as a flap or tab adjacent the second surface portion. Moreover, the fourth surface portion is, furthermore, at least partially in contact with the third surface portion. Thus, at least one of the third and fourth surface portions can easily be gripped when it is desired to open the package and a separating force can be applied to these surface portions in order to separate the sealed first and second surface portions from each other and allow access to the product contained in the package. It is to be noted that the fourth surface portion is only partially covered with an adhesive, so that the fourth surface portion is only partially bonded to the third surface portion. Thus, there are parts of the third and fourth surface portions which are not bonded to each other and which can, therefore, easily be gripped in order to open the package. Thus, the inventive package is easy to open which is beneficial for the consumer.

As far as the adhesive is concerned, with which the fourth surface portion is only partially covered, a bonding force between the adhesive and the substrate, as well as the coating, respectively, has a second and a third value, respectively. Both the second and third values are greater than the first value. Since the first value is related to the bonding force between the coating and the substrate, a separation of the third and fourth surface portions from each other will cause the coating to adhere to the adhesive and will, thus, be removed from the third surface portion. This is because, as mentioned above, the bonding force between the adhesive and the substrate as well as the coating is higher than the bonding force between the coating and the substrate. Thus, the adhesive will, firstly, adhere to the fourth surface portion. Secondly, due to the bonding force between the adhesive and the coating, which are at least partially in contact with each other, the coating will adhere to the adhesive and will be removed from the substrate of the third surface portion, because of the relatively low bonding force, having the first value at this interface.

Thus, when the package is first opened, the coating is at least partially removed from the third surface portion. For example, the removed part of the coating can represent the word "opened" so that after the first opening, this message is conveyed to the consumer. In a similar manner, also that part of the coating, which stays on the third surface portion, can represent this word or any graphic or written information in order to indicate that the package has already been opened or has been tampered with. It will also be appreciated that a higher opening force will be required for the first opening than for any subsequent openings. This is because during the first opening, the coating will at least partially be removed from the third surface portion. Subsequently, the removed part of the coating adheres to the adhesive on the fourth surface portion and will, also after re-closing, stay on the adhesive of the fourth surface portion. Thus, during subsequent openings, only that part of the adhesive, which adheres to the third surface portion, and not that part of the adhesive, which is covered with the removed coating, needs to be separated from the third surface portion. Due to the reduced surface area, which adheres to the third surface portion, the opening force is reduced and the consumer can additionally "feel" that the package has already been subjected to a first opening. As detailed above, the consumer can also visually recognise this fact, because at least a part of the coating of the third surface portion has been removed.

The visual effect is obtained as a colour of the coating is different than a colour of the third surface portion and/or the fourth surface portion and/or the adhesive. When the colour of the coating is different from the colour of the third surface portion, the coating can be partially removed from the third surface portion during the first opening, so that the consumer will realize that only a part of the coating (having a different colour than the third surface portion) has stayed with the third surface portion. This remaining part can convey the "opened" message by exhibiting this or similar word(s), or by representing specific graphic information. Moreover, the colour of the coating can be different from the colour of the fourth surface portion, because the adhesive on the fourth surface portion will at least be partially covered with the coating after the first opening. Therefore, the difference in colour between the coating which adheres, by means of the adhesive, to the fourth surface portion, and the fourth surface portion itself can be used for indicating the first opening and/or tampering. Finally, the surface area of the fourth surface portion, which is covered with adhesive, can be greater than the area of the third surface portion, which covered with coating. Thus, the coating, which has been removed from the third surface portion, can, after the first opening, be surrounded by areas of adhesive on the fourth surface portion. Thus, when a colour difference between adhesive and the coating is present, the first opening or tampering information can be conveyed to the customer in this manner.

Thus, the coating and the adhesive are, in the final package, at least partially in contact with each other, so that separating the fourth surface portion from the third surface portion will at least partially remove the coating from the third surface portion. As mentioned, the third and fourth surface portions can represent flaps or tabs which are in contact with each other, so that the coating provided on the third surface portion and the adhesive provided on the fourth surface portion are in contact. Due to the relationship of the various bonding forces described above, the process of separating the fourth surface portion from the third surface portion will at least partially remove the coating from the third surface portion. As detailed above, due to the colour differences, this removal of the coating can provide an indication that the package has been opened or tampered with.

As will be appreciated from the above, the measures described herein do not require any separate mechanical features, such as additional stickers or labels. Rather, the coating and the adhesive can easily be applied to the substrate when the substrate, which can, for example, be present as a web, is traveling through the packaging machine, and a succession of products are packaged, for example, in a flow-wrap or flow-pack type package. Moreover, the package according to the invention can be produced in two steps, which can particularly be performed at different locations, with the production of a packaging material being a first step. In connection therewith, a substrate, which can be present as a web, can be coated and/or printed with the above-described adhesives, sealant and coatings such as ink or primer. The packaging material can then be wound to rolls or reels, which can be delivered to a different company, which intends to package their goods with the described packaging material. The company using the packaging material then only has to unwind the packaging material and the goods can be packaged without any additional devices or steps being required during packaging. This advantageously keeps the packaging machinery uncomplicated and the necessary investments for the company using the packaging material low.

In particular, the adhesive on the fourth surface portion can be the same as, and can be continuous with, the adhesive which is used for sealing the first and second surface portions to each other and, possibly, further surface portions. Also the coating of the third surface portion can be readily applied to the substrate in the process of packaging food products. It should, moreover, be mentioned that the tamper evidence feature is realized in the third and fourth surface portions, which are adjacent the first and second surface portions, respectively, which are sealed to each other. Thus, the seal, as such, is not affected by the tamper evidence feature. In particular, the seal can be provided in a way to ensure reliable sealing and, preferably, re-closability, whereas the tamper evidence feature, which is present in the third and fourth surface portions, can, substantially independent from the seal, be provided in a reliable and efficient way.

In particular, the first and second surface portions, respectively, which form the seal, are preferably not formed in a way to integrate or surround the third and fourth surface portions, respectively, or be surrounded by the latter. Rather, the third surface portion is adjacent the first surface portion and there is, if any, a single borderline between them, which is preferably straight. Moreover, one or more further surface portions can even be present between the first and the third surface portion. The above also is applicable to the relationship between the second and fourth surface portions. In particular, the third and fourth surface portions are preferably formed on free edges of the package, so that they can constitute two gripable flaps. Finally, all of the described surface portions are preferably formed substantially rectangular. The invention is applicable to the package described in EP 1 288 139 A1 of the Applicant, the disclosure of which is, with regard to the package as such, including the seal and flaps thereof, incorporated herein by reference. It should be mentioned that the invention is also applicable to so-called vertical form fill seal bags and pouches. In such types of packages, for example, pieced goods such as candy or small confectionary products can be packaged. In connection with vertical form fill seal bags and pouches, it should be noted that the surface portion comprising the coating can be parallel as well as substantially perpendicular to the machine direction, i.e. the direction, in which the packaging material is conveyed through the machine. This also applies to any horizontal packaging machines. Moreover, one or more of the seal described above can be formed as heat seals instead of cold seals.

Preferred embodiments of the inventive package are described in the further claims.

As mentioned above, the substrate can be made of any suitable material. Currently, the use of a film for the substrate is preferred, as a film material will advantageously allow the invention to be used with a flow-wrap type of package.

Moreover, the invention is not dependent on the first and second surface portions being present on the same side of the substrate. However, it is advantageous if the first and second surface portions are indeed on the same side of the substrate, as an efficient packaging method can be used, as a fin seal can be provided between the first and the second surface portions being on the same side of the substrate.

As regards the seal between the first and second surface portions, this can be formed by an adhesive, such as a cold seal, a heat seal, a pressure sensitive glue or any other suitable type of seal. In particular, pressure sensitive glue can be covered with a heat seal lacquer in order to seal the package. In this case, the seal can be broken along the pressure sensitive glue. All of these embodiments represent a reliable and efficient type of seal.

Generally, the invention, due to the tamper evidence feature, is exhibiting specific advantages in re-closable packages, so that it is currently preferred that the seal between the first and the second surface portions is re-closable.

The first and second surface portions can have a shape and/or structure to provide a completely closed package. For example, the package can be a type of envelope with three permanently closed sides, and the remaining side being closed by the seal between the first and the second surface portions. Because of the flow pack type of package, which is currently preferred for the package described herein, it is, however, preferred that there is a fifth and/or sixth surface portion, which is respectively sealed to itself. As mentioned above, the first and second surface portions can constitute a fin seal. In this type of package, the fifth and/or sixth surface portion can constitute one or two end seals, which are substantially perpendicular to the fin seal. In particular, a relatively wide seal, which is oriented substantially perpendicular to the machine direction, can be provided between two products, and a cut can be made in the area of the end seal in a direction perpendicular to the machine direction, in order to separate two packages, each containing a product, from each other. Thus, the fifth and/or sixth surface portion are preferably substantially perpendicular to the first and/or second surface portions.

As it provides advantages, when the third and/or fourth surface portions constitute flaps or tabs which can be used for opening the seal between the first and second surface portions, it is advantageous when the third and/or fourth surface portions or immediately adjacent the first or the second surface portions, respectively.

The third and the fourth surface portions are preferably of a different size which implies that one of these surface portions extends beyond the other one. In this manner, it can be easily realized that gripping tabs or flaps are present. Moreover, due to the different extension, one or both of the third and fourth surface portions can be gripped in order to separate them from each other and open the package. In connection with the differing size of the third and fourth surface portions, reference can additionally be made to the above referenced application of the Applicant.

Generally, the above-described effects of the coating, based on the colour thereof, can be achieved with any type of coating. However, since the coating essentially has to provide the indicating effect, it is currently preferred that the coating is a primer or an ink, which adheres to the substrate of the package.

As regards the amount of coating, tests have shown that the coating can advantageously be applied with 0.5 to 2 g/m$^2$ with 1.4 to 1.6 g/m$^2$ being preferred.

It has, furthermore, been realized in experiments, that the reliability of the coating being removed from the third surface portion can be improved when the coating is, in addition to the adhesive provided on the fourth surface portion, at least partially covered with an adhesive. In particular, when the adhesive on the fourth surface portion and the adhesive covering the coating are at least partially in contact with each other, the adhesive of the fourth surface portion will at least partially adhere to the adhesive covering the coating and will improve the reliability, with which the coating, which is present underneath the adhesive on the third surface portion, is removed. Moreover, it can be advantageous to have continuous areas, which are covered with adhesive, so that it is advantageous to cover at least a part of the coating on the third surface portion with adhesive. It is to be emphasized that the described feature, namely the coating, in addition to the fourth surface portion, being at least partially covered with adhesive, represents a feature which can be provided on the package described herein, in which the fourth surface portion does not necessarily have to be only partially covered with the adhesive. In other words, in this case, the fourth surface portion can be completely covered with adhesive. The feature, that the coating is at least partially covered with adhesive, can be combined with one or more of the features mentioned above and below as desired.

In view of the even higher force for reliably removing a part of the coating from the third surface portion, it is, as mentioned, advantageous if the adhesive on the fourth surface portion and the adhesive covering the coating are at least partially in contact with each other.

In this context, the effects can be further improved when the bonding force between the adhesive on the fourth surface portion and the adhesive covering the coating has a fourth value, which is higher than the first value. Thus, the coating on the third surface portion will reliably be removed during first opening.

It is currently preferred that the adhesive is a cold seal or a heat seal. In this embodiment the adhesive can be formed continuous with a seal between the first and second, as well as on the fifth and/or sixth, surface portions, which provide advantages with regard to the covering of the required areas of the substrate with the seal.

When the adhesive is pressure sensitive glue or adhesive, the packaging of the food product can be facilitated, because the bonding of the adhesive can be realized by pressure, without heat or similar effects being necessary. Furthermore, the adhesive can contribute to the re-closability of the package and the package can be improved in this regard.

Experiments have shown that it is advantageous if the adhesive is applied with 3 to 5 g/m$^2$, preferably 3.5 to 4.0 g/m$^2$.

The seal between the first and the second surface portion and/or the seal of the fifth surface portion and/or the seal of the sixth surface portion and/or the adhesive can comprise a pattern. This can reduce the amount of adhesive or sealant, which is required, as the necessary effects can possibly be obtained by a reduced amount of sealant or adhesive, which is, for example, applied in a dot and/or a stripe pattern.

As can be taken from above, the relationship between the various values of bonding forces is most relevant for obtaining the desired effects. As regards the absolute values, 0.5 to 1.5 N/15 mm have proven advantageous for the first value of the bonding force. In this context, the given force corresponds to that force, which is necessary to peel a strip of material having a width of 15 mm and being coated with the respective material. This force can, in particular, be measured in accordance with the draft for DIN 55529.

The second value of the bonding force can be 4.5 to 7 N/15 mm, as tests have shown.

As regards the third value of the bonding force, 2 to 4 N/15 mm, preferably greater than 3 N/15 mm have shown to be advantageous.

Finally, 2.5 to 4 N/15 mm are preferred for the fourth value of the bonding force.

Generally, the inventive package can be applied to any kind of product. However, for food products, in particular confectionary products, the provision of both re-closability and tamper evidence, which the invention provides, is particularly relevant, so that a food product, particularly a confectionary product, which is packaged with a package, in one of the above-described embodiments, is part of the invention. In this context, the food product can be a tablet, block or bar shaped product. However, the food product can also be one or more pieced goods.

The invention is, furthermore, constituted by a method for producing a packaging material or for packaging a food product as described herein. Corresponding to the package, which is to be obtained, at least a first and a second surface portion of a substrate are covered with a sealant. A third surface portion adjacent the first surface portion is covered with a coating and a bonding force between the coating and the substrate has a first value. Moreover, only a part of a fourth surface portion adjacent the second surface portion is covered with an adhesive and a bonding force between the adhesive and the substrate as well as the coating, respectively, has a second and a third value, respectively, both the second and third value being higher than the first value. Moreover, the colour of the coating is different than the colour of third and/or fourth surface portions and/or the adhesive. As described before, these steps can either be part of a method for producing a packaging material or for packaging a food product. When a packaging material is to be produced, the substrate is covered with sealant and coating in the above-described manner. However, there can be applications, where the packaging material is covered with either the sealant or the coating, as well as applications, in which only some of the surface portions are covered with sealant and/or coating. Such embodiments are part of the invention. In practice, further surface portions can be covered at a different location, for example, when the packaging material is to be used for packaging one or more products. In the method for producing a packaging material, the method can comprise the step of winding the packaging material so as to produce a roll or reel material which can then be delivered to the company that intends to use the packaging material for packaging their goods.

In the method for packaging the food product, the first and second surface portions are sealed and the coating and the adhesive are at least partially brought in contact with each other. This method provides an efficient and uncomplicated method for producing a package as described above, which is particularly improved with regard to tamper evidence.

Preferred embodiments of the inventive method substantially correspond to the preferred embodiments of the package and are described in the further claims. In connection with the inventive method, it should be mentioned separately that the substrate can be conveyed in a machine direction and the first and/or second surface portion can extend substantially in the machine direction, so that they constitute a fin seal. However, the first and/or second surface portions as well as the third and fourth surface portions can also extend substantially perpendicular to the machine direction, in other words in a cross machine direction and can, thus, be formed as end seals of the package. Moreover, the seal between the first and/or a second surface portion as well as the seal of the fifth and/or sixth surface portion can be embossed with a pattern in the method described herein. The embossed pattern can, for example, be one or more lines or stripes, which extend substantially parallel to the length of the respective surface portion. In particular, in a preferred embodiment, embossed lines or stripes extend substantially parallel to the length of both the first and second and the fifth and sixth surface portion. In this context, the length or extension of the respective surface portion is the longer dimension of the surface portion, which can have a substantially rectangular shape.

The invention, moreover, provides a machine for producing a packaging material or for packaging a food product which is adapted to carry out the above-described method and/or produce the inventive package or the packaging material described below. Thus, the packaging machine comprises a device for covering at least a first and a second surface portion of a substrate with a sealant. Moreover, the machine comprises a device for covering a third surface portion adjacent the first surface portion with a coating, a coating force between the coating and the substrate having a first value. The machine also comprises a device for covering only part of a fourth surface portion adjacent the second surface portion with an adhesive. With these devices, a packaging material, as described below, can be produced. In this context, not all of the above-described devices do necessarily have to be present. Rather, only one or some of the mentioned devices can be provided in order to produce an intermediate type of packaging material. In particular, the remaining devices can be provided within a packaging machine which is then adapted to "complete" the packaging material and which can, additionally, be adapted to package one or more products.

When a packaging machine is to be provided, a device for sealing the first and second surface portion and a device for bringing the coating and the adhesive at least partially in contact with each other are provided.

Preferred embodiments of the machine correspond to preferred embodiments of the inventive method and are described in the further claims. The machine can comprise a device for conveying the substrate in a machine direction, the first and/or second surface portions extending substantially in the machine direction.

The machine can be kept uncomplicated when the device for covering the first and second surface portions and the device for covering the fourth and/or the fifth and/or the sixth surface portions, are constituted by a single device. Thus, continuous surface portions covered with an adhesive can be formed by a single device.

The machine can comprise a printer for covering the described surface portions with the coating in the form of ink or a primer.

The invention finally provides a packaging material, in which the first and second, third and fourth surface portions are covered as described above for the final package. Such a packaging material can also have only some of the described surface portions covered in the described manner, and either the coating or the sealant can be applied to the packaging material. The packaging material can be produced and then supplied to the company that intends to use it for packaging goods. In particular, the packaging material can be provided as a reel or roll material.

BRIEF DESCRIPTION OF THE DRAWINGS

Hereinafter, preferred embodiments of the invention will be described with reference to the drawings, in which.

DETAILED DESCRIPTION

Figure 1:
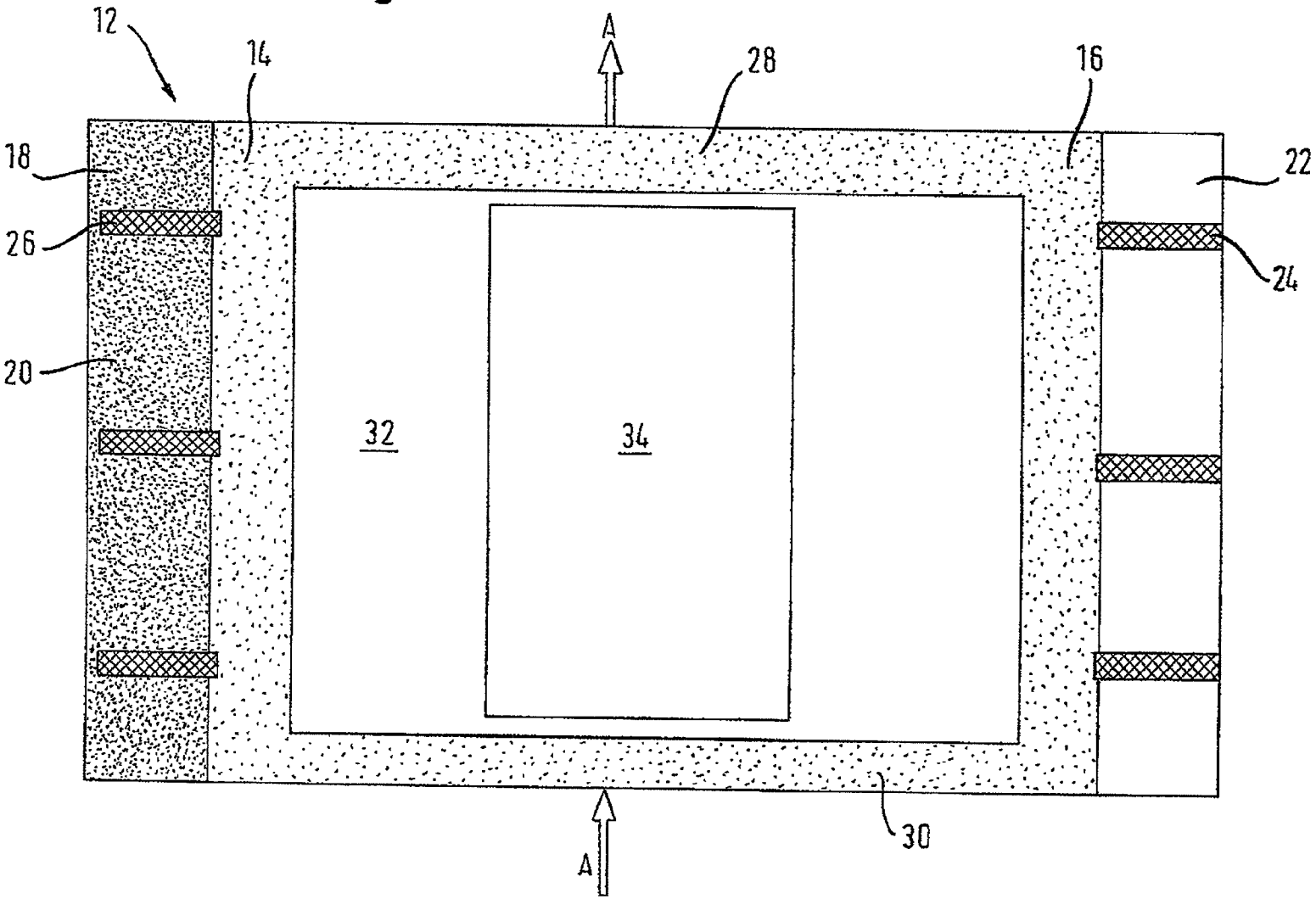
FIG. 1 shows a plan view of the substrate of the inventive package in a first embodiment before closing the package.

As FIG. 1 shows, the substrate 12 of the inventive package is, in the preferred embodiment, a substantially rectangular piece of film material. This piece can be part of a web, which is conveyed through a packaging machine in the machine direction A. In the final package, the white area 32, which is also substantially rectangular and located in the centre of the substrate 12, will be used to enclose a product 34. Moreover, in the final package, the package will be sealed by seals, which are formed between a first 14 and a second 16 surface portion as well as by sealing a fifth 28 and a sixth 30 surface portion to itself. On the basis of the above terminology, the seal of the fifth 28 and sixth 30 surface portions 30 constitute end seals, and the seal between the first 14 and the second 16 surface portions can constitute a fin seal. In the embodiment shown, the first, second, fifth and sixth surface portions, which constitute the various seals, form a kind of rectangular frame. In particular, they are, in this preferred embodiment, formed on the same side of the substrate 12.

As can also be taken from the drawings, a third 18 and a fourth 22 surface portion are present adjacent the first 14 and second 16 surface portions, respectively.

As described in the above-referenced earlier application of the Applicant, these surface portions can constitute tabs or flaps, which can be gripped by the consumer in order to separate the first 14 and second 16 surface portion from each other in order to open the seal and get access to the contents of the package. As indicated by the colouring of the third 18 surface portion this surface portion 18 is covered with a coating 20. In the embodiment shown, the coating 20 covers the entire third surface portion 18 but this is not necessary. Furthermore, FIG. 1 shows an embodiment in which the colour of the coating 20 is remarkably darker than the colour of the substrate 12, which is visible in the uncovered and uncoated central area 32. In the embodiment shown, the coating 20 is, moreover, partially covered by an adhesive 26. In particular, three strips of adhesive, which extend substantially perpendicular in the machine direction A, are applied on the coating 20. It is to be understood, however, that the strips or stripes can have a different shape and/or size, and the areas, where the adhesive and/or the coating is applied, can have any suitable appearance.

In the embodiment shown, the fourth surface portion 22 comprises similar strips of adhesive 24. In particular, the strips of coating 20 and/or adhesive 26 (FIG. 1) can be present every 10 to 50 mm. In particular, the fourth surface portion 22 is only partially covered with adhesive 24, so that areas remain free of adhesive, which can be gripped in order to separate the third 18 and fourth 22 surface portions from each other and, as a consequence, separate the first 14 and second 16 surface portions from one another in order to open the package.

FIG. 1 shows the substrate before a food product is packaged. In particular, the substrate shown in FIG. 1 can be part of a packaging material in the form of a web, on which the pattern of sealant, adhesive and coating is repeated several times. In the case shown, the web extends in the machine direction A, with the fifth surface portion 28 of a first substrate being substantially adjacent the sixth surface portion 30 of another substrate. When a food product is to be packaged, the product indicated at 34 is placed on the central area 32 of the substrate, and the substrate is wrapped around the food product 34. During this process, the fifth 28 and sixth 30 surface portions are sealed to themselves, and the first 14 and second 16 surface portions are sealed to each other.

Moreover, the third 18 and fourth 22 surface portions come in contact with each other. In particular, the adhesive 24, partially covering the fourth surface portion 22, contacts the adhesive 26 provided on the coating 20. It should be mentioned that this adhesive 26 is not absolutely necessary. Rather, the adhesive 24 on the fourth surface portion 22 can be in direct contact with parts of the coating 20. When such a package is first opened, the third 18 and fourth 22 surface portions are separated from each other, and the adhesive 24, provided on the first surface portion 22, removes a part of the coating 20.

Figure 2:
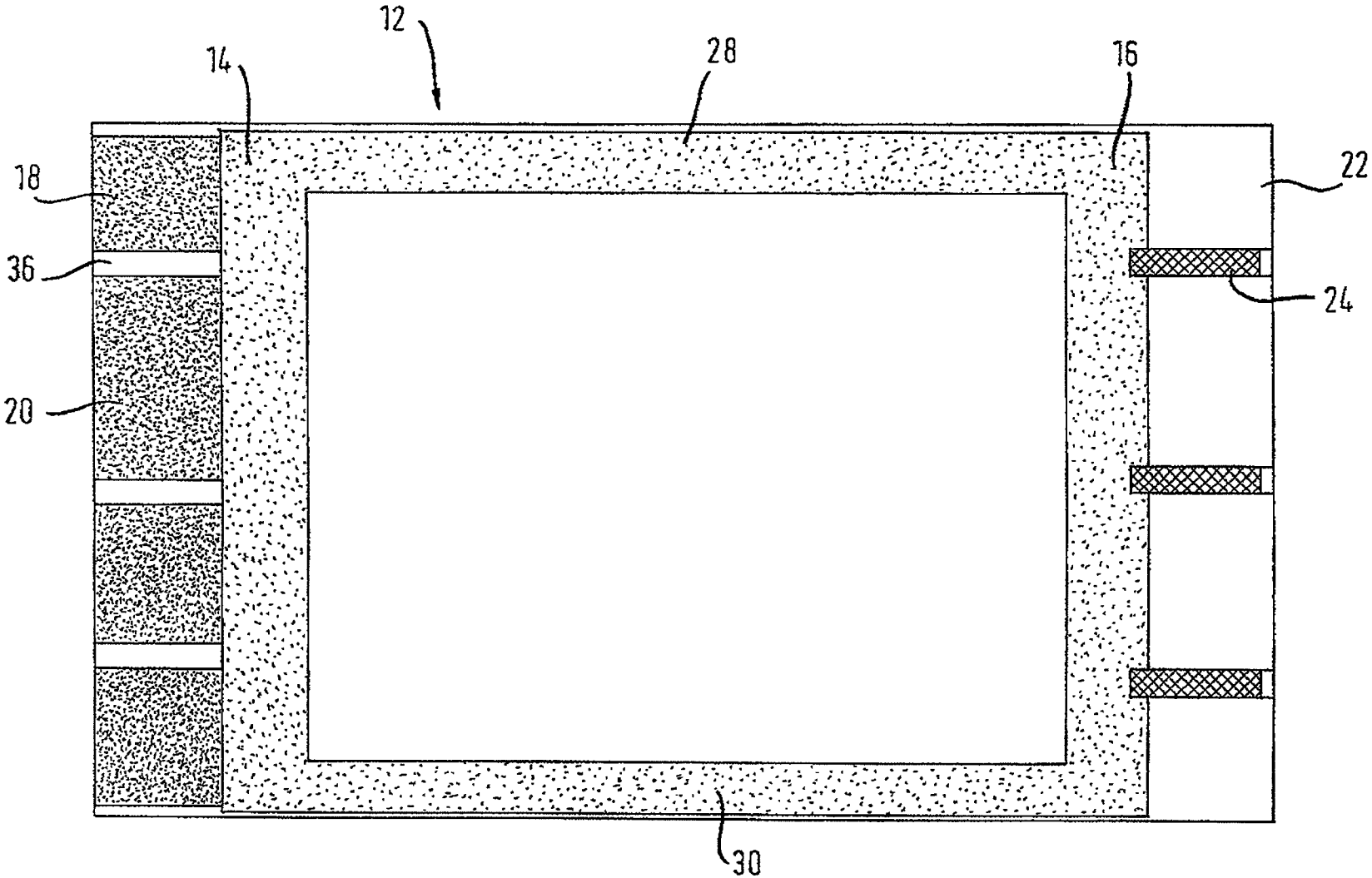
FIG. 2 shows the substrate of FIG. 1 after the first opening.

FIG. 2 shows the substrate corresponding to that of FIG. 1 after the first opening. As can be seen, the adhesive 24 on the fourth surface portion 22 is covered with coating, which has been removed from the third surface portion 18. Since the colour of the coating 20 differs from that of the fourth surface portion 22, the consumer can see that the package has been opened. In particular, the adhesive 24 on the fourth surface portion 22 could be applied in a manner to show the word "opened", so that the "opened" message is displayed after first opening.

In the embodiment shown, the coating 20 also has a different colour than the third surface portion 18. Therefore, in view of the fact that the entire third surface portion 18 is, in the embodiment shown, covered with a coating 20, strips 36 on the third surface portion 18, which are free of coating, are visible. In the embodiment shown, the substrate has a uniform, light, preferably white colour throughout all surface portions, so that the above effects are obtained. However, it is also sufficient if the coating has a colour, which is different from that of the third 18 or the fourth 22 surface portion. Moreover, when the area of the fourth surface portion 22, which is covered with adhesive 24, is greater than the area of the third surface portion 18, which is covered with coating 20, it is sufficient if the colour of the coating 18 differs from that of the adhesive 24. Since all of the coating will be removed from the third surface portion, the difference of colour between the coating, which covers part of the adhesive on the fourth surface portion 22, and the surrounding adhesive will be visible.

When the package is to be re-closed, the first 14 and second 16 surface portions can again be sealed to each other, and the fifth 28 and sixth 30 surface portion can be sealed to themselves. This provided re-closability and requires a certain opening force also for subsequent openings. However, as can be taken from the drawing, the adhesive 24 on the fourth surface portion 22 is covered with coating, which will not adhere to the third surface portion 18. Thus, there is no bonding force active in this area and the consumer can also feel that there is a lower opening force than for the first opening. This provides tamper evidence in addition to the above-described visual effects. It is also evident that the substrate does not necessarily have to be brought into the state shown in FIG. 2, when the package is to be opened. Rather, if only a part of the product, such as a part of a chocolate bar or tablet is to be consumed, it will be sufficient if the seal between the first 14 and the second 16 surface portions is opened partially, and the adjacent end seal, i.e. the seal of the fifth 28 or the sixth 30 surface portion is opened. When the remainder of the product is to be kept in the re-closed package, only the opened seals have to be re-closed. In particular, when the package is opened only partially, only one or two of the stripes of coating can be removed. In the case of a different pattern of coating 20 and/or adhesive 24 and 26 on the fourth surface portion 22 and the coating 20, respectively, only part of the coating is removed during partial opening, which still indicates that the package has at least been partially opened.

Figure 3:
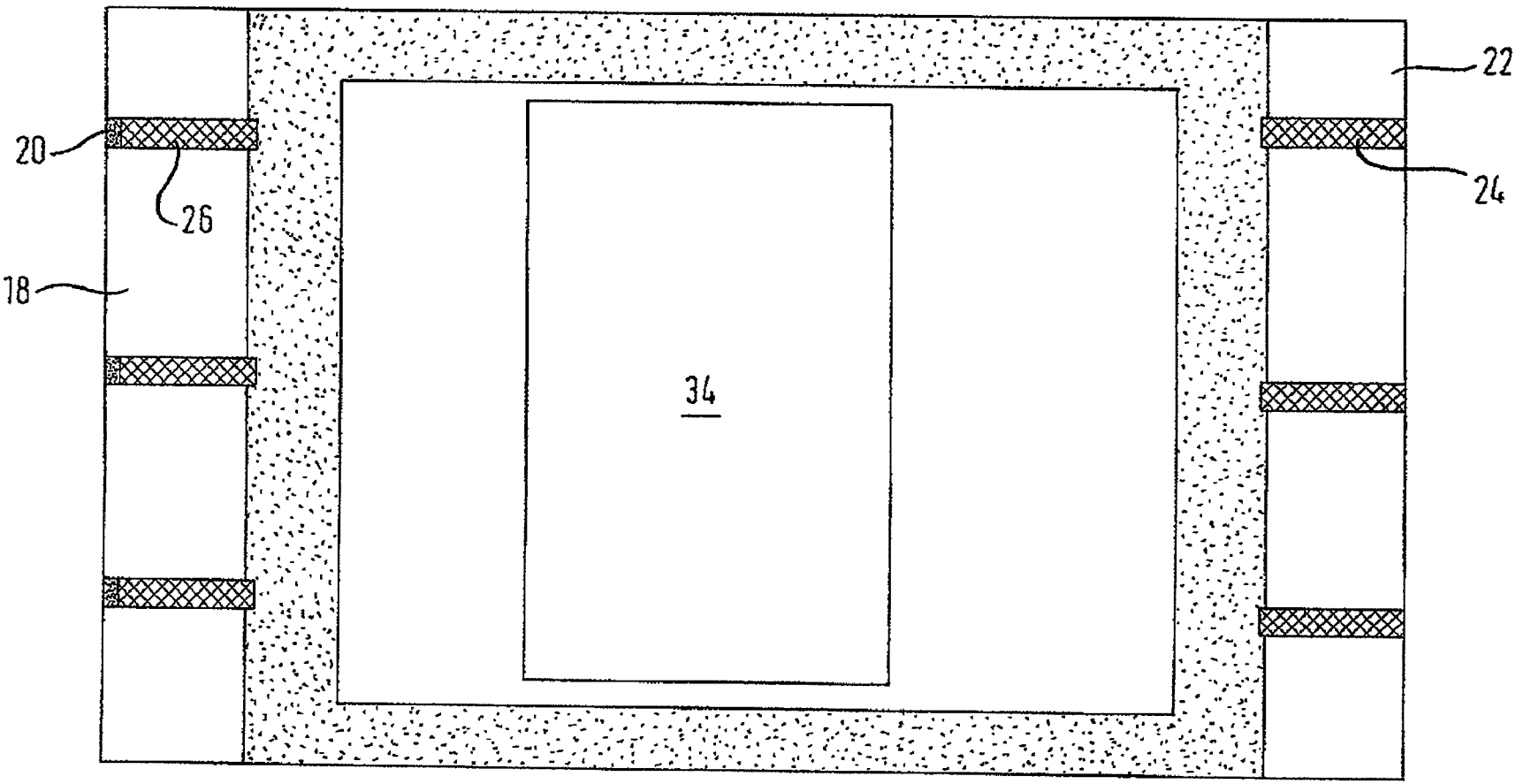
FIG. 3 shows a plan view of the substrate of the inventive package in a second embodiment before closing the package.

As can be taken from FIG. 3, the second embodiment of the inventive package differs from the first embodiment only with regard to that part of the third surface portion 18, which is covered with a coating 20. In particular, in the embodiment shown in FIG. 3, only three strips are covered with coating. In the embodiment shown, the location and size of the strips correspond to the location and size of the strips of adhesive 26 covering the coating 20 in the embodiment of FIG. 1. However, it is to be understood that the pattern, with which the coating 20 is applied to the third surface portion 18, could be completely different. Moreover, in the embodiment shown in FIG. 3, the strips of coating 20 are, at least to a large extent, covered by adhesive 26, similar to the strips of adhesive 26 in the embodiment of FIG. 1. As noted above, these strips of adhesive 26 are not necessary. Rather, also the strips of adhesive 24, which are provided on the fourth surface portion 22, will come into contact with the strips of coating 20, when the package is closed, in order to package a product indicated at 34.

Due to the relationships of the various bonding forces, the adhesive 24 of the fourth surface portion 22 will remove the coating 20 from the third surface portion 18 in order to provide tamper evidence. In particular, as the fourth surface portion 22 adheres to the third surface portion 18, due to the adhesive 24, the coating 20 is not visible to the consumer before the first opening. After the first opening, or when the package has been tampered with, the coating 20 covers the adhesive 24 on the fourth surface portion 22 and is, therefore, visible. In particular, the coating could form the word "opened" in order to inform the consumer that there has been a first opening.

In the embodiment shown in FIG. 3, substantially all of the coating provided on the third surface portion 18 can be removed. Therefore, the colour of the coating 20 is in this case different from that of the fourth surface portion 22 and/or the adhesive 24 provided on the fourth surface portion 22, in order to make the coating visible, which has been removed from the third surface portion 18 and adheres to the adhesive 24 on the fourth surface portion 22. Thus, the appearance of the fourth surface portion 22 after the first opening will substantially correspond to that of the fourth surface portion 22 of the first embodiment, shown in FIG. 2, whereas the third surface portion 18 will be substantially free of adhesive and coating 20. Both of the embodiments described above can be produced easily and efficiently and products, in particular food products, can be packaged with the above-described tamper evidence features being applied in line, i.e. during packaging the product. As an alternative, the described substrate can be part of a packaging material comprising a plurality of portions constituting plural substrates, with which a plurality of food products can be packaged with the final package exhibiting the described tamper evidence features.

Figure 4:
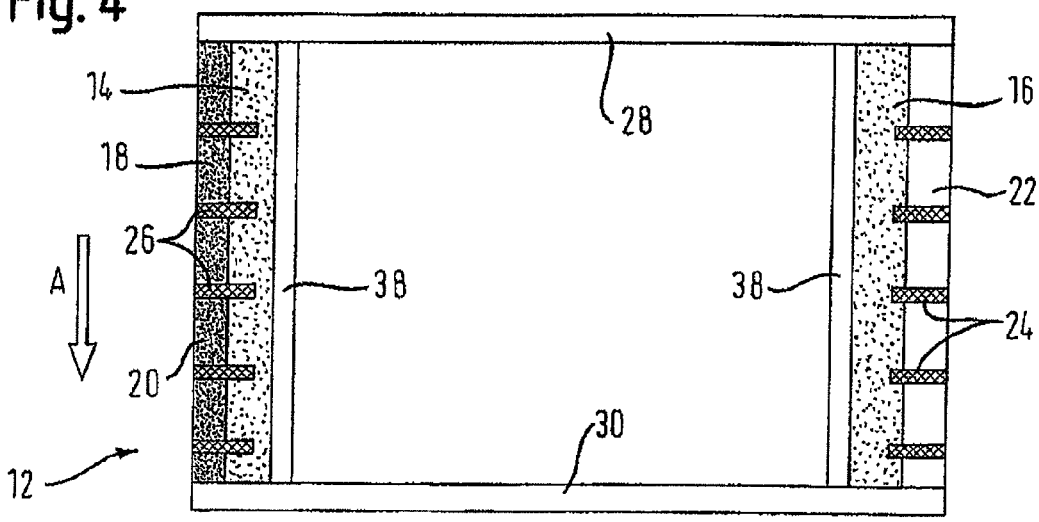
FIG. 4 shows a plan view of the substrate of the inventive package in a third embodiment before closing the package.

FIG. 4 shows a plan view of the substrate 12 in a second embodiment. As regards the first 14, second 16, third 18 and fourth 22 surface portions this embodiment generally corresponds to that of FIG. 1. This also applies to the stripes of adhesive 24, which are provided on the fourth surface portion 22, the coating 20 of the third surface portion and the stripes of adhesive 26, which are provided on the coating 20 and, partially, in the embodiment shown, on the first surface portion 14. The embodiment of FIG. 4 differs from that of FIG. 1 because a fifth 28 and a sixth 30 surface portions are provided as heat seals. Moreover, a heat seal area indicated at 38 can be present adjacent the first 14 and second 16 surface portions, respectively. It should be noted that there can be a distance or spacing between one or both heat seal areas 38 and the first 14 and second 16 surface portions, respectively. Moreover, the heat seal areas 38 can also be present between the first and third and between the second and fourth surface portions. With the described heat seals, hermetic sealing of the final package can be realised. In other words, the package can be formed airtight and vapour proof, so that the final package is also suitable for products such as cheese or coffee, which require hermetic packages. It can be mentioned that the heat seal area 38 can also be provided as a lacquer on top of the adhesive or sealant of the first 14 and second 16 surface portions. When both heat seals and re-closable adhesives are provided, as in the embodiment of FIG. 4, a package can be provided, which is hermetically sealed in the original state, and which is re-closable after the first opening. It should also be mentioned that the heat seal features of the embodiment of FIG. 4 can also be provided to the first and second embodiments described above, as well as the fourth embodiment, described below. In the embodiment of FIG. 4, the machine direction is indicated with arrow A and a web, extending in the direction A and constituting a plurality of substrates as shown in FIG. 4, can be used in a vertical packaging machine for producing packages in the form of bags or pouches. Such a bag will be described with reference to FIG. 6 below.

Figure 5:
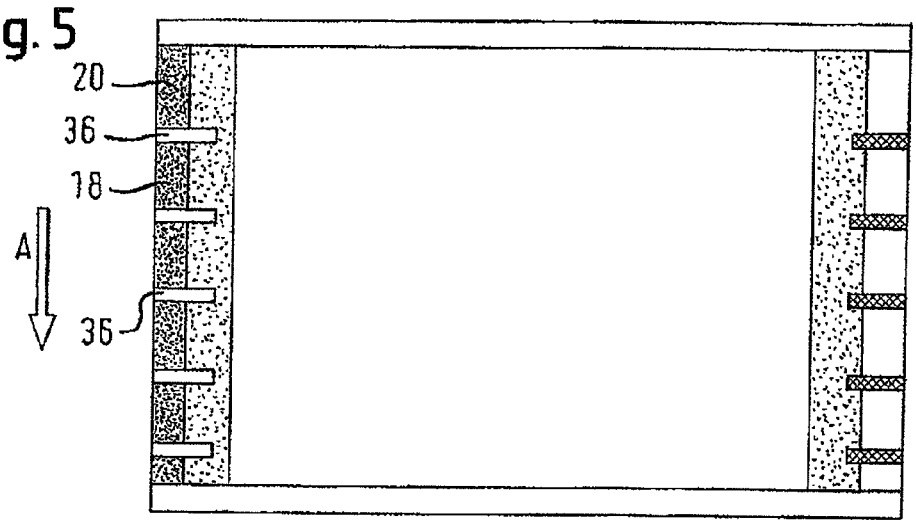
FIG. 5 shows the substrate of FIG. 4 after the first opening.

FIG. 5 shows the substrate of FIG. 4 in the fully opened state. In other words, the bag or pouch produced from the substrate of FIG. 4 is fully opened, and all seals are broken in order to show the plan view corresponding to FIG. 4. As can be taken from FIG. 5, in a manner corresponding to that described above with reference to FIGS. 1 and 2, a part of the coating 20 of the third surface portion 18 has been removed so that coating free, stripes 36 are visible which indicate that the package has been opened and/or been tampered with. This function fully corresponds to that described above with reference to FIGS. 1 and 2 and does not have to be repeated here. In particular, the modification of FIG. 3 is also applicable to the embodiment of FIGS. 4 and 5.

Figure 6:
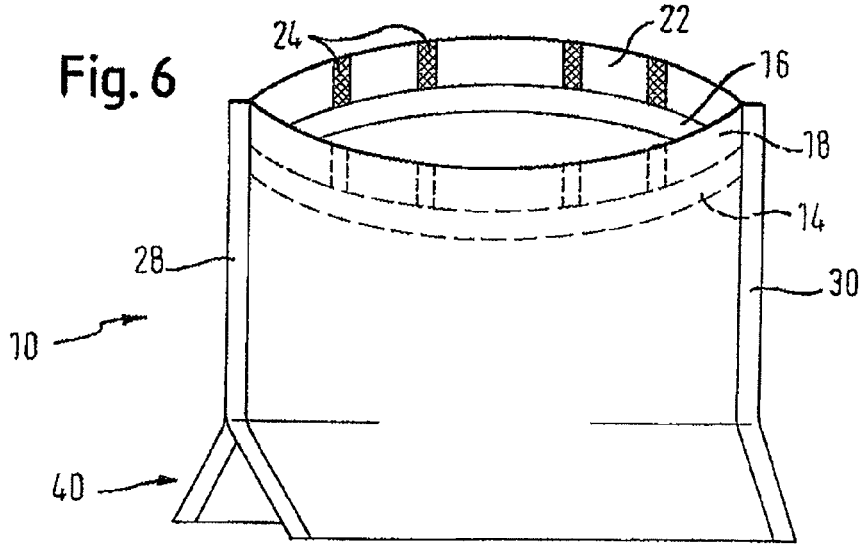
FIG. 6 shows a perspective view of a bag which can be produced using the substrate of FIG. 4.

FIG. 6 shows a perspective view of a bag 10 produced from the substrate of FIG. 4. In particular, the bag 10 is shown in an opened state and it can be seen that the orientation has been changed by 90 degrees relative to the orientation shown in FIGS. 4 and 5. In particular, during manufacture of the packaging material and/or the package, the heat seals of the fifth 28 and sixth 30 surface portions can be called end seals. However, in use, as can be taken from FIG. 6, these will constitute the sides of the bag 10. The top is constituted by the first 14, second 16, third 18 and fourth 22 surface portion, comprising the tamper evidence features as described above. In particular, stripes of adhesive 24 covered with coating 20, which has been removed from the third surface portion 18 are visible on the fourth surface portion 22. As regards the bottom 40 of the bag 10, this is formed in a way to create a stand-up bag by appropriately folding the substrate 12 during production of the bag. In particular, a fold line, which is substantially parallel to the machine direction A is created in approximately the centre of the substrate in order to produce the bottom shown at 40 in FIG. 6. In particular, the heat seals of the fifth 28 and sixth 30 surface portions have the shape of an inverted Y, which is produced by folding a centre portion of the substrate 12 inwards which is an upwards direction in the orientation of the bag 10 shown in FIG. 6. As regards further details of such a bag or pouch, as well as the manufacture thereof, reference can be made to the WO 03/080441 A1, the disclosure of which is incorporated herein by reference.

Figure 7:
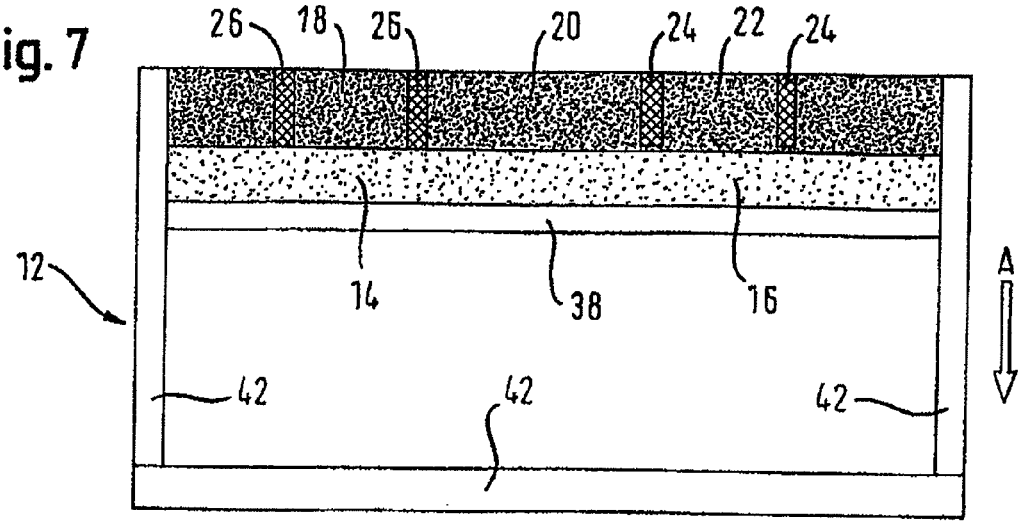
FIG. 7 shows a plan view of the substrate of the inventive package in a fourth embodiment before closing the package.

FIG. 7 shows a further embodiment of a substrate 12, from which a package in the form of a bag can be produced. In this case, those surface portions providing the tamper evidence features are provided at an "end" of the substrate considering the machine direction A. At the sides and a second end of the substrate 12, heat seal areas 42 are provided, which are sealed to themselves. In a sense, the substrate 12, shown in FIG. 7, is folded about a line running through the centre of the substrate 12 parallel to the machine direction A. Moreover, as with the embodiment of FIGS. 4 and 5, a heat seal area 38 can be present adjacent the first 14 and second 16 surface portion. It should be noted that the first 14 and second 16 surface portions are in this embodiment continuous with each other. This also applies to the third 18 and fourth 22 surface portions. The heat seal area 36 can also be spaced from the area covered with adhesive constituting the first 14 and second 16 surface portions. Furthermore, the heat seal area 38 can also be present between the first and second surface portions, on the one hand, and the third and fourth surface portions, on the other hand. In this embodiment, the area constituting the first 14 and second 16 surface portions is essentially sealable to itself, with the left half of this area constituting the first surface portion 14, and the right half constituting the second surface portion 16.

Figure 8:
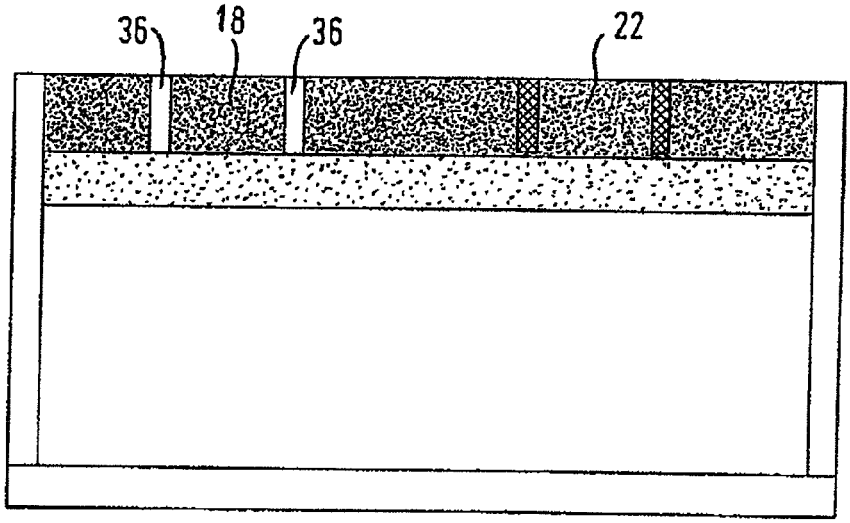
FIG. 8 shows the substrate of FIG. 7 after the first opening.

In the embodiment of FIG. 7, the entire third 18 and fourth 22 surface portions are covered with a coating 20. In the embodiment shown, two stripes 24 of adhesive are formed on the fourth surface portion 22, and two corresponding stripes 26 are formed on the coating 20 of the third surface portion 18. When the package is formed, the stripes 24 are at least partially brought into contact with the stripes 26. Thus, when the package is opened, the coating is removed from the third surface portion 18, as shown in FIG. 8. However, unless the bonding forces differ from each other, the coating could also be removed from the fourth surface portion 22. As a further alternative, in the embodiment shown comprising two stripes 24 and 26, one coating free stripe 36 can be present on the third surface portion 18, and one coating free stripe 36 can be present on the fourth surface portion 22.

Figure 9:
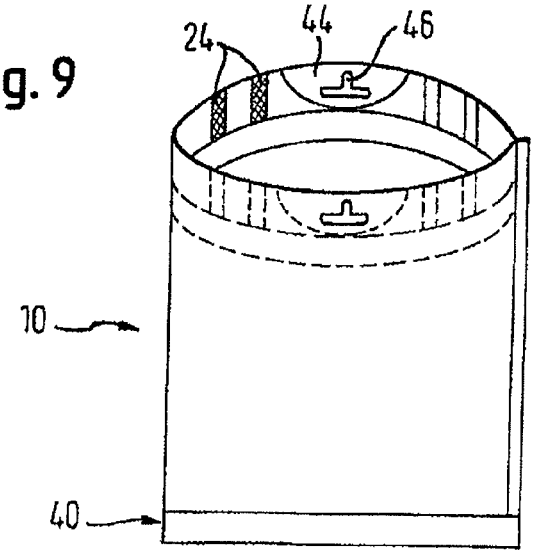
FIG. 9 shows a perspective view of a bag, which can be produced using the substrate of FIG. 7.

FIG. 9 shows a package in the form of a bag 10, which can be formed from the substrate shown in FIG. 7. The heat seal areas 42, extending parallel to the machine direction A, constitute a side of the package and the heat seal area 42, extending substantially perpendicular to the machine direction A, i.e. the above-mentioned second end seal constitutes the bottom 40 of the bag. The tamper evidence features are provided at the top of the package. In this context, FIG. 9 shows a somewhat different embodiment with four stripes of adhesive 24, which are covered with removed coating after first opening. Between the second and third stripe a gripping area 44 and a hole 46 for hanging the bag to a suitable carrier can be provided. As regards the embodiment of FIGS. 7 to 9, it can be mentioned that the fourth surface portion 22 does not have to be covered with coating entirely. Rather, only the area underneath the stripes 24 of adhesive and/or the surroundings thereof, can be covered with coating, in order to provide the tamper evidence feature, when the stripes of adhesive 26, which are provided on the third surface portion, remove the stripes of adhesive 24 including the coating underneath from the fourth surface portion 22. Finally, it should be mentioned that any features, which are mentioned with regard to a single or only some embodiments above, are applicable to all other embodiments as well.

What is claimed is:

1. A package formed from a substrate, the package comprising:

a first and a second surface portion of the substrate, wherein the first and the second surface portions are sealed to each other;

a third surface portion adjacent the first surface portion, and at least partially covered with a coating;

a bonding force between the coating and the substrate, the bonding force having a first value;

a fourth surface portion adjacent the second surface portion, and only partially covered with an adhesive;

a bonding force between the adhesive and the substrate having a second value and a bonding force between the adhesive and the coating having a third value, where both the second and the third value are greater than the first value; and a color of the coating different from a color of the third surface portion, the fourth surface portion, or the adhesive and wherein the coating and the adhesive are at least partially in contact with each other, so that separating the fourth surface portion from the third surface portion will at least partially remove the coating from the third surface portion.

2. A food product, in particular a confectionary product, packaged according to the package of claim 1.

3. The package of claim 1 wherein the substrate is a film.

4. The package of claim 3 wherein the first and the second surface portions are on the same side of the substrate.

5. The package of claim 3 wherein the first and the second surface portions are sealed by the adhesive selected from the group consisting of a cold seal, a heat seal, and a pressure-sensitive glue.

6. The package of claim 3 wherein the seal between the first and the second surface portions is re-closable.

7. The package of claim 3 wherein the third surface portion is immediately adjacent the first surface portion and the fourth surface portion is immediately adjacent the second surface portion.

8. The package of claim 3 wherein the third and the fourth surface portions are of a different size.

9. The package of claim 3 wherein the adhesive is a cold seal or a heat seal.

10. The package of claim 3 wherein the adhesive is a pressure sensitive glue.

11. The package of claim 3 wherein the first value of the bonding force is from about 0.5 N/15 mm to about 1.5 N/15 mm.

12. The package of claim 3 wherein the second value of the bonding force is from about 4.5 N/15 mm to about 7 N/15 mm.

13. The package of claim 2 wherein the first and the second surface portions are continuously connected by a fifth or a sixth surface portion, which is respectively sealed to itself.

14. The package of claim 13 further comprising a pattern at the seal between the first and the second surface portions, the seal of the fifth surface portion, the seal of the sixth surface portion, or the adhesive.

15. The package of claim 3 wherein the coating is a primer or ink.

16. The package of claim 15 wherein the coating is applied at about 0.5 $g/m^2$ to about 2 $g/m^2$.

17. The package of claim 16 wherein the coating is applied at about 1.4 $g/m^2$ to about 1.6 $g/m^2$.

18. The package of claim 3 wherein the coating is at least partially covered with adhesive.

19. The package of claim 18 wherein the adhesive on the fourth surface portion and the adhesive covering the coating are at least partially in contact with each other.

20. The package of claim 19 wherein a bonding force between the adhesive on the fourth surface portion and the adhesive covering the coating has a fourth value, where the fourth value is greater than the first value.

21. The package of claim 20 wherein the fourth value of the bonding force is from about 2.5 N/15 mm to about 4 N/15 mm.

22. The package of claim 3 wherein the adhesive is applied at about 3 $g/m^2$ to about 5 $g/m^2$.

23. The package of claim 22 wherein the adhesive is applied at about 3.5 $g/m^2$ to about 4.0 $g/m^2$.

24. The package of claim 3 wherein the third value of the bonding force is from about 2 N/15 mm to about 4 N/15 mm.

25. The package of claim 24 wherein the third value of the bonding force is greater than about 3 N/15 mm.

26. A packaging material formed from a substrate, the packaging material comprising:

a first and a second surface portion of the substrate, wherein the first and the second surface portions are covered with a sealant;

a third surface portion adjacent the first surface portion, and at least partially covered with a coating having a bonding force between the coating and the substrate, where the bonding force has a first value;

a fourth surface portion adjacent the second surface portion and only partially covered with an adhesive;

a bonding force between the adhesive and the substrate having a second value and a bonding force between the adhesive and the coating having a third value, where both the second and the third values are greater than the first value; and a color of the coating different from a color of the third surface portion, the fourth surface portion, or the adhesive.

27. The packaging material of claim 26 wherein the material is provided as a reel material.

* * * * *

UNITED STATES PATENT AND TRADEMARK OFFICE

CERTIFICATE OF CORRECTION

PATENT NO. : 7,740,923 B2
APPLICATION NO. : 11/279497
DATED : June 22, 2010
INVENTOR(S) : Exner et al.

It is certified that error appears in the above-identified patent and that said Letters Patent is hereby corrected as shown below:

In Col. 14, Line 65, in Claim 13, delete "claim 2" and insert -- claim 3 --.

Signed and Sealed this

Fourteenth Day of September, 2010

David J. Kappos

David J. Kappos
*Director of the United States Patent and Trademark Office*